US006816042B1

(12) United States Patent
Noyes et al.

(10) Patent No.: US 6,816,042 B1
(45) Date of Patent: Nov. 9, 2004

(54) PROCESS TO MAKE LIGHTWEIGHT OBJECTS

(75) Inventors: Michael J. Noyes, Stockton, CA (US); Lee Mancheong Edouard Lee-Yow, Longmont, CO (US)

(73) Assignees: Applied Aerospace Structures Corp., Stockton, CA (US); Custom Microwave Inc., Longmont, CO (US)

( * ) Notice: Subject to any disclaimer, the term of this patent is extended or adjusted under 35 U.S.C. 154(b) by 89 days.

(21) Appl. No.: 10/465,261

(22) Filed: Jun. 19, 2003

Related U.S. Application Data

(62) Division of application No. 09/885,578, filed on Jun. 20, 2001, now Pat. No. 6,630,876.
(60) Provisional application No. 60/212,765, filed on Jun. 20, 2000.

(51) Int. Cl.[7] ..... H01P 3/12
(52) U.S. Cl. ..... 333/248; 333/239; 333/21 R; 333/245; 333/176; 333/202; 333/219; 333/242
(58) Field of Search ..... 333/248, 239, 333/21 R, 245, 176, 202, 219, 242

(56) References Cited

U.S. PATENT DOCUMENTS

| | | | | | |
|---|---|---|---|---|---|
| 3,982,215 | A | | 9/1976 | Lo et al. | 333/73 |
| 4,155,058 | A | * | 5/1979 | Boujet | 333/109 |
| 4,160,962 | A | * | 7/1979 | de Keyser et al. | 336/181 |
| 4,772,861 | A | * | 9/1988 | Young | 333/21 R |
| 4,906,951 | A | * | 3/1990 | Moeller | 333/242 |
| 5,143,577 | A | * | 9/1992 | Haas et al. | 216/24 |
| 5,398,010 | A | | 3/1995 | Klebe | 333/239 |
| 5,846,638 | A | * | 12/1998 | Meissner | 428/220 |
| 5,932,522 | A | * | 8/1999 | Bell et al. | 333/202 |
| 6,630,876 | B1 | * | 10/2003 | Noyes et al. | 333/248 |
| 6,639,876 | B2 | * | 10/2003 | Kalis et al. | 369/30.06 |
| 2002/0104822 | A1 | * | 8/2002 | Naydenkov et al. | 216/24 |
| 2002/0134671 | A1 | * | 9/2002 | Demaray et al. | 216/79 |

* cited by examiner

*Primary Examiner*—Michael Tokar
*Assistant Examiner*—Lam T. Mai
(74) *Attorney, Agent, or Firm*—Rick Martin; Patent Law Offices of Rick Martin, P.C.

(57) ABSTRACT

An "inside out" process is used to make RF antennas and components or higher frequency components and/or optics. An electroformed single or multi layer of metal, such as copper, is applied to a reusable or disposable mandrel. Additional metal or composite components and/or pieces may be attached to the electroform by means of further electroforming, and/or applying adhesive and/or soldering. Any composite material (for example, fiberglass or carbon fiber reinforced plastic) is then applied selectively or uniformly around the electroform and/or additional components for structural reinforcement, and/or enhancement of thermal stability and/or thermal conductivity. The mandrel is then removed by physical or chemical means. Adhesion over temperature and humidity extremes, surface finish, uniform metalization thickness, and surface electrical conductivity are all vastly improved over equivalent electroplated composites.

12 Claims, 20 Drawing Sheets

81
80
VIEW FIG. 8A 81
8
8
THIN METAL FLASH (93)
VENT HOLE (92)
803
802
MANDREL (80)
91
90
FLANGE (94)
801
THIN METAL FLASH (98)
COMPOSITE (97)
APPROX .004
ELECTRODEPOSITED
METAL (95)
EPOXY OR SOLDER (96)

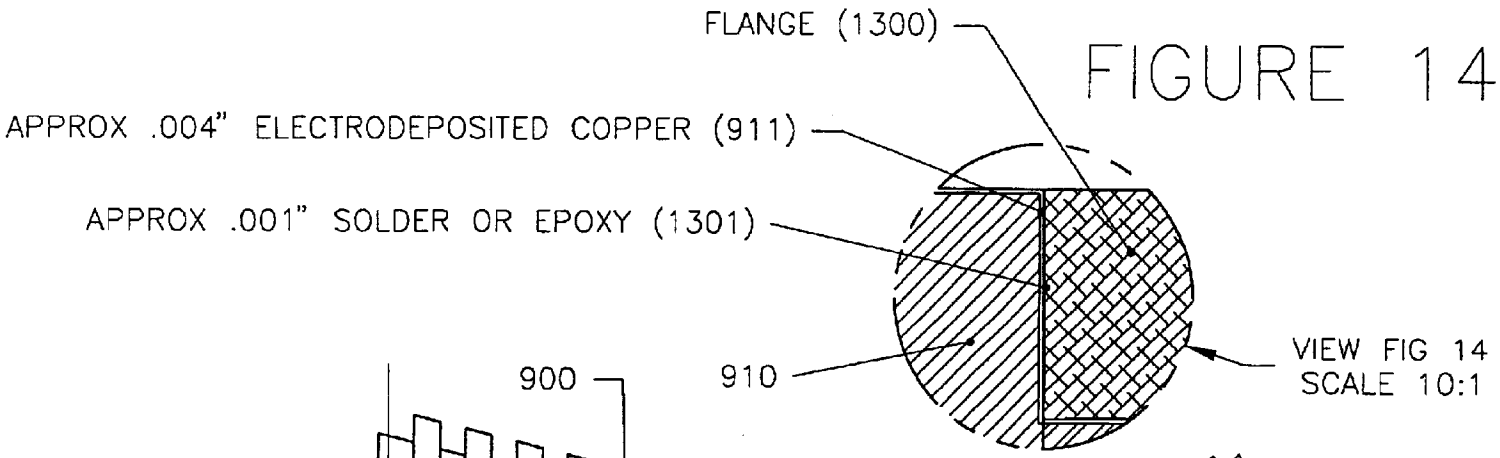
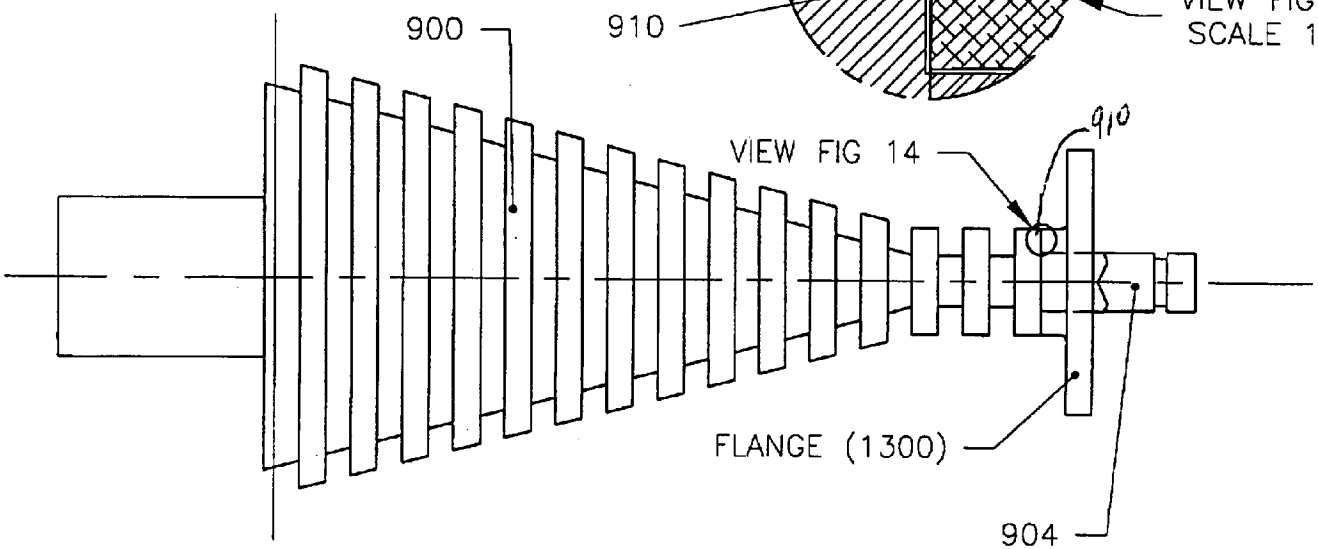
FIGURE 13

PROCESS TO MAKE LIGHTWEIGHT OBJECTS

CROSS REFERENCE PATENTS

This application is a divisional of utility application Ser. No. 09/885,578 filed Jun. 20, 2001 now U.S. Pat. No. 6,630,876 which claims benefits of provisional application Ser. No. 60/212,765 filed Jun. 20, 2000. This application incorporates by reference U.S. Pat. No. 5,398,010 (1995) to Klebe and 3,982,215 (1976) to Lo et al.

FIELD OF THE INVENTION

The present invention relates to manufacturing a hollow electronic component such as a waveguide or antenna or optical component, wherein the inner surface of the hollow object needs to have a precisely smooth thin film coating such as gold or copper, and wherein the object must also have a low weight, and be structurally sound.

BACKGROUND OF THE INVENTION

Prior art "outside in" techniques for manufacturing a hollow electronic component such as a microwave waveguide filter comprise the steps of forming the device from the outside in. See U.S. Pat. No. 5,398,010. Typically a fiberglass composite like shell is hand laid on a disposable or reusable mandrel. This fiberglass like shell is called a composite material in the trade. It may be composed of carbon fiber reinforced plastics, graphite fibers, reinforced plastics, carbon-carbon composites, dielectric fibers, other fiber polymer-matrix composites, and metal/metal matrix composites. The mandrel has the desired final shape of the hollow component to be made. Once the fiberglass composite like shell is made the mandrel is removed by any one of several methods including physical retraction.

At this point in the process a delicate and rigid fiberglass composite like structural shell is formed having a rough surface in the inside and outside surfaces. The typical surface smoothness might be 64 rms.

Next a series of chemical plating processes are done to coat the interior of the hollow device with an electronically functional precise coating(s). Such coatings include gold, silver, copper and nickel. Examples of these processes are taught in U.S. Pat. Nos. 3,982,215 and 5,398,010, wherein both of these references are incorporated herein by reference. Both of these patents teach an "outside in" process to create a composite material waveguide having a copper inside coating.

The main problem is quality control to coat an interior rough surface of a composite material pipe with close tolerance metal coatings. This problem leads to high costs for the resultant devices, wherein the ultimate usefulness for these devices is often found in a space application. For space use one pound in a satellite can cost up to $30,000 in lift off and operational costs.

Extremely good electrical or optical performance has been achieved by the old technique using a disposable mandrel and then electroforming complex components or assemblies as a single piece or assembly around the outside of the mandrel. The materials used for this have typically been copper and/or silver. Structural reinforcement has been provided by the additional thickness of copper and/or nickel. The resultant hollow devices are heavy and have limited thermal stability properties.

Improved thermal stability and/or lower mass have been realized by the electroless and/or electro plating of preformed composite components as shown in the '010 and '215 patents. However, this technique has demonstrated problems with plating thickness uniformity, plating adhesion, plating surface roughness, and plating adhesion degradation with exposure to moisture, which all lead to poor or unacceptable electrical performance.

The techniques of the '010 and '215 patents have generally been limited to producing straight pipe segments, unless a two part mold is formed for a complex shape like a right angle, and then the two parts are bonded together and then electroplated inside.

At least five problems arise from the "outside in" manufacturing techniques. First the roughness of composite materials creates a best surface smoothness of 32 rms. This is the result of coating copper over a rough surface of fiberglass composite (generally called a composite material).

Second the fiberglass composite shell does not have the extraordinary dimensional accuracy of ±0.0002 inch that a machined metal mandrel can achieve.

Third when coating the inside of an irregular shaped fiberglass composite shell, linear flow of the electrolyte is inhibited. This is especially true for shapes with cavities and blind ends. Without linear flow a linear coating depth cannot be achieved. Therefore, the rough surface defects of the fiberglass composite shell are made worse by uneven coating of the copper (or chosen metal) on them.

Fourth a multi-piece mold to create a single piece irregular shaped product adds unnecessary cost to the final product.

Fifth there exists a ratio of cross sectional area of a pipe to the necessary smoothness of the inside of the pipe to be useful as a microwave waveguide. The smaller the cross sectional area, the smoother the surface smoothness must be, with a required rms of 32 or lower. A fiberglass composite shell cannot be coated to obtain this necessary smoothness.

The present invention is based on the technique of applying from the "inside out" materials over a precision mandrel via a known electroplating process. Then the fiberglass composite shell is applied over the newly formed metal layer while the mandrel is still in place. Finally the mandrel is etched away leaving a fiberglass composite shell with a super smooth inner coating. The resultant waveguide device is low mass, has improved thermal stability, improved thermal performance without the typical adhesion and/or surface roughness issues associated with plating composites from the "outside in."

The term waveguide component also further includes what is known in the industry as co-axial waveguides, square co-axial waveguides, and TEM line components. The present invention can create extremely lightweight versions of the latter devices, wherein the prior art method for creating the latter devices is limited to a heavier version using known methods such as machining, casting, and die brazing.

SUMMARY OF THE INVENTION

The main aspect of the present invention is to provide a method to make from the "inside out" a lightweight hollow structure, using a sacrificial or reusable mandrel.

Another aspect of the present invention is to provide a method to create spacecraft waveguides and the like, wherein each component has a hollow core with a precision coating thereon, and/or a curved precision reflective surface.

Another aspect of the present invention is to provide a method to manufacture various components simultaneously.

Another aspect of the present invention is to provide a method to protect certain pieces of the hollow component, for example an epoxy seam between two sub-components, by means of coating the seam with a non-reactive metal before bathing the component in a chemical to erode the mandrel away.

Another aspect of the present invention is to provide a means to protect the composite structure from the chemical etching process used to erode the mandrel away, the protective step being to coat the composite material with a non-reactive material.

Another aspect of the present invention is to provide a high strength and a high stiffness end product formed by the inside out process.

Another aspect of the present invention is to provide a ultra-low loss (of transmitted signal) waveguide component formed by the inside out process.

Other aspects of this invention will appear from the following description and appended claims, reference being made to the accompanying drawings forming a part of this specification wherein like reference characters designate corresponding parts in the several views.

A mandrel can be fabricated out of stainless steel, aluminum, zinc, plastic, or any metal alloy. The mandrel can be fabricated by conventional milling, turning, stamping, shearing, casting, or injection molding. Selective areas on the mandrel maybe masked where no plating is desired. The mandrel is prepared to accept plating depending on the composition of the mandrel material. Any material that can be metalized can be used as a mandrel in this invention.

Typically, aluminum alloy 6061 is used as the mandrel due to the alloy's machining and processing characteristics. Conventional techniques are used in the preparation of the aluminum alloy for plating. The mandrel is first cleaned in a non-etch alkaline cleaner. The mandrel's surface is then deoxidized in a stabilized sodium hydroxide solution. Alloy metals are then stripped from the deoxidized surface with a desmut solution, typically either 50% nitric or a chromic acid solution. The mandrel is then processed through a double zincate step where a layer of zinc is applied to the surface, stripped off in 50% nitric, and reapplied on the mandrel. Once prepared the mandrel can now accept metal plating from either electroplating strike baths or electroless plating baths. Typical processes for this initial metalization are, but are not limited to, copper, gold, silver, and nickel strike processes, and electroless copper, nickel, gold, and silver processes. The mandrels are then electroformed up to a thin to moderate thickness, 50 millionth to 0.040 of an inch, in one metal layer or utilizing multi-layers of metals. Typical electroforming metals are, but are not limited to, copper, nickel, gold, and silver.

Stainless steel mandrels are prepared for electroplating by passivating the surface with a suitable passivation technique such as a 50% nitric acid dip, a chromate coating or other standard passivation methods. A release layer is then applied to the mandrel, typically either a layer of electroplated gold or an immersion chromate coating. The mandrels are then electroformed up to a thin to moderate thickness, 50 millionth to 0.040 of an inch, in one metal layer or utilizing multi-layers of metals. Typical electroforming metals are, but are not limited to, copper, nickel, gold, and silver.

Zinc alloys and other conductors are prepared by conventional techniques. Zinc alloys typically follow the process described above for aluminum alloys.

Plastic and other non-conductive mandrels are initially metalized with conventional techniques utilizing stannous chloride/palladium chloride chemistry or reduction silver processes. A thin layer of electroless copper or nickel is typically plated prior to electroforming. The mandrels are then electroformed up to a thin to moderate thickness, 50 millionth to 0.040 of an inch, in one metal layer or utilizing multi-layers of metals. Typical electroforming metals are, but are not limited to, copper, nickel, gold, and silver.

Additional metal or composite components and/or pieces may then be attached to the electroform by means of further electroforming, an adhesive or solder. In certain instances, a thin metal flash is required over the assembly to cover the epoxy or solder joints. The assembly is then typically glass bead blasted and cleaned in an alkaline soak solution. The assembly is then activated in an appropriate activator bath based on the electroformed metal, typically a persulfate solution for copper, an acid fluoride solution for nickel and a 3% peroxide solution for silver. If epoxy is to be metal covered, the assembly is then plated with either an electroplating or electroless plating process. If solder is to be metal covered, the assembly is first processed through fluoroboric acid to activate the solder prior to the metal flash in an electroplating or electroless plating process.

The composite structural reinforcement for the component or assembly is then applied. It is this material that supplies the desired structural support (either rigid or flexible) to the end product. This can be done by applying a fabric, unidirectional, or random reinforcing fibers in a supporting matrix around or onto the electroform(s). The reinforcement may be applied as a pre-impregnated material or as separate fiber resin, and adhesive components. This can also be done by applying carbon fiber and/or foam, or carbon-carbon composites, or dielectric fiber, or other fiber polymer-matrix composites, or metal/metal matrix composite around the electroform(s). This technique is very attractive in cases where there are several components in very close proximity, approximately 0.020 to 0.100 of an inch spacing, forming an assembly. This approach allows for very rigid, lightweight and compact structure and eliminates the need for structural brackets, stiffeners, and flanges for each component. Other composite material can be made up of carbon and/or dielectric continuous or discontinuous fibers in an epoxy or polymer matrix.

The Coefficient of Thermal Expansion of the electroformed assemblies may be varied uniformly or selectively by the appropriate selection and/or orientation of varying CTE fibers. This may be useful for highly thermally precision components for high frequency RF or optics use such as filters, feed horns, mirrors, polarizers etc.

The thermal conductivity may be modified by appropriate selection and alignment of fibers and matrix resin and/or adhesives. The thermal conductivity can be selectively increased or decreased to meet specific requirements. High thermal conductivity for dissipation or low thermal conductivity for thermal isolation can each be achieved selectively and/or independently in the same or different components.

The Dielectric constant of the composite material can be varied selectively and/or independently to enhance the RF radiating and/or transmission or charging/insulation performance of the component. Dielectric lenses and/or windows may be incorporated into the composite reinforcement selectively or independently as required.

After curing, depending on the composite material used, a chemical resistant coating may be required to protect the composite when chemically removing-the mandrel from the electroform. Plastic coatings such as Viton®, latex, Neoprene®, silicon and natural rubbers can be sprayed or brushed on to provide the coating. Plastic shrink tubes can be utilized to provide protection, such as Teflon® based shrink tubing.

The composite can also be electroplated over with a suitable metal, typically copper to provide the required protection during the chemical dissolution of the mandrel. Composite metallization utilizes conventional techniques such as Shipley-Ronal Direct Metalization Technology. Once metalized the composite can now be plated with a thin layer of metal, typically 0.0001 to 0.0005 " thick copper from an electroless or electroplating bath.

The mandrel is physically or chemically removed in this final step for production of this finished piece. Removal of aluminum based mandrels is accomplished by dissolving the aluminum in a 60 to 80 g/l sodium hydroxide bath operating at 180° to 200° F. The dissolution solution can contain stabilizers and/or dissolution aids.

Removal of stainless steel mandrels is accomplished by heating, with a propane torch or other heating method, the mandrel and electroform while pulling the mandrel from the attached-electroform utilizing a hydraulic or mechanical puller.

Removal of zinc based mandrels is typically accomplished by dissolving the zinc in a 10% solution of hydrochloric acid.

Removal of plastic based mandrels is accomplished by dissolving the plastic in a suitable organic solvent, such as methylene chloride for ABS.

If a protective coating was applied to the composite, the coating is typically removed prior to finishing the part. Shrink tube and peelable plastic coatings are typically physically removed from the electroform by peeling. Other plastic coatings are removed by soaking in a suitable organic solvent. Removal of the metal coating utilizes an acid etch solution, typically a persulfate solution. The electroform interior and exterior metal surfaces are masked or isolated from the acid to eliminate acid etching of critical surfaces In summary the present invention's "inside out" process has numerous advantages over the prior art "outside in" method. A more detailed comparison of these two methods follows below as well as a description of the electroforming process which is a known process in itself, although it has never been combined with the "inside out" process steps of the present invention.

The "Outside In" method of producing a shell has the following limitations:

1. Poor plating adhesion. The "Outside In" method relies on electroless plating which produces a mechanical bond. Peel strength of plating metal to plastics typically has 6 to 20 lbs/in which is not practical in most microwave applications.

2. Plating adhesion degradation. Depending on the porosity of the composite material, some amount of process chemicals (i.e. cleaners, etchants, sensitizers, accelerators), can be absorbed during processing. This trapped solution will etch the plating resulting in pin holes, cracks, or blisters over time. This is unacceptable for microwave hardware especially for space-flight quality hardware.

3. Plating surface roughness. The process of molding composite material typically results in surface finishes 64 rms or worse. In addition the "Outside in" plating method employs surface roughening techniques such as glass bead blasting and chemical etching to increase plating adhesion. These roughing techniques leave the surface of the plastic with typically greater than a 200 rms surface finish. For most microwave applications in the 15 GHz range or higher, a surface finish of 32 rms or better is very desirable.

4. Non-uniform plating thickness. Mass transport of fresh plating solution becomes more difficult when plating waveguides with cross sectional areas less than 0.750 "×0.375" (about 0.28 square inch) and/or very long waveguide sections from the outside in. Disparities in chemical concentrations in the waveguide cause uneven plating thickness, increased surface roughness and sometimes no plating in certain areas. This is why almost all "Outside In" plated devices are (0.750"×0.375") or larger size waveguides.

5. Limited to very thin plating thickness. Plating thickness of more than 0.0005" is generally not practical for the "Outside In" method. If thicker plating is desired, non-uniformity increases and dimensional tolerances degrade. In addition electroless copper is known for increasing roughness with increasing thickness.

6. Restriction to one type of substrate. Due to the fact that different activation is required for different substrates, it is very difficult to plate from the "Outside In" when the device is made up of different substrates.

7. Restriction to simple shapes such as a hollow rectangular pipe. Any device that has an irregular shape with cavities and blind ends, such as a rectangular or circular corrugated structure as in filters and horns, are not practical for the "Outside In" method for the following reasons:

The shell has to be made in two or more parts that are then glued together. This can add significant cost to the hardware.

During the electroless plating process the reaction of the metal ion with a reducing agent results in metal plating and hydrogen gas which can easily be trapped in blind ends and corners. This results in non-plated areas, which is unacceptable in microwave communication hardware. See FIG. 24.

Dimensional accuracies are greatly compromised by gluing multiple parts to form a more complex hardware.

8. Difficulty with tolerances better than +/−0.003". The process of making the shell inherently limits the dimensional accuracy that can be achieved due to shrinkage.

COMPOSITE STRUCTURES

Composite material is well known and established as a method of producing high strength and lightweight structures. It has been used for decades in various applications including structural panels for aircrafts and spacecrafts.

The "Inside Out" Method

This method combines the benefits and heritage of electroforming and composite structures to produce high electrical performance, high strength, and lightweight microwave components and integrated assemblies.

The "inside out" method of producing a part provides the following benefits:

1. Excellent plating adhesion. The "Inside Out" method relies on a chemical bond between the epoxy and the metal layer. Typical shear strength between the composite layer and the metal surface is between 3,000 and 6,500 pounds per square inch and peel strength of up to 65 pounds per inch. This is significantly better than the "Outside in" method.

2. No Plating adhesion degradation. There is no trapped solution or salts because the bonding process is not performed in a solution.

3. Very smooth internal surface. The internal surface finish produced by the "Inside Out" method is as good as what electroforming can provide. Internal surface finishes as good as 4 rms can be achieved 4. Uniform plating thickness. Plating on the outside of the mandrel or form inherently results in a more uniform coverage regardless of the size of the part.

5. No limitation on plating thickness. Plating thickness from 50 millionth to 40 thousandths of an inch or more can easily be applied to the mandrel prior to bonding the composite material.

6. No restriction on the type of structural material used. Since bonding is achieved primarily by an adhesive, a variety of materials such as epoxies can be used to attach to the plated mandrel.

7. Parts with high degree of internal complexity and close tolerance can be made on a one-piece mandrel, and there is no hydrogen entrapment.

8. The accuracy achieved using the "Inside Out" method relies on how accurate electroformed parts can be made. Tolerance as close as +/−0.0002" can be realized.

ELECTROFORMING

Electroforming is a highly specialized and well known process for fabricating a metal part by electroplating over a mandrel or form which is subsequently removed. This process has been used for decades to make complex and high precision microwave devices for use on ground-based, airborne, ship-borne, and space based systems.

Main advantages of electroforming are:

1. A faithful reproduction of the form or mandrel, to within 40 millionth of an inch, without the shrinkage and distortion associated with other metal forming techniques such as casting, stamping, metal injection molding, or drawing. This is very desirable for microwave devices since the electrical performance has a direct correlation with the internal dimensions of the device.

2. Very tight tolerances can be achieved, limited only by the dimensional accuracy of the machined mandrel. Since most mandrels are made from metal, tolerances as close as +/−0.0002" (two tenths of a thousandth) of an inch can be realized.

3. Surface finishes of the mandrel are faithfully reproduced on the internal surface of the part. Finishes as good as 8 rms or better can be achieved 4. Uniform plating can be achieved throughout the internal surface of the entire part.

5. Parts with very high degree of complexity and tight tolerances can be realized in a single piece construction.

6. Good Conductivity

ELECTRICAL CONDUCTIVITY

| MATERIAL | CONDUCTIVITY $(\text{Ohm-cm})^{-1}$ |
|---|---|
| Copper | 0.60 |
| Gold | 0.43 |
| Silver | 0.63 |
| Nickel | 0.15 |
| Electroless nickel | 0.04 |

BRIEF DESCRIPTION OF THE DRAWINGS

FIG. 13 is a side plan view of the mandrel of FIG. 11 with a flange.

FIG. 14 is a close up of the joint between the mandrel and the flange of FIG. 13.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF DRAWINGS

Figure 1:
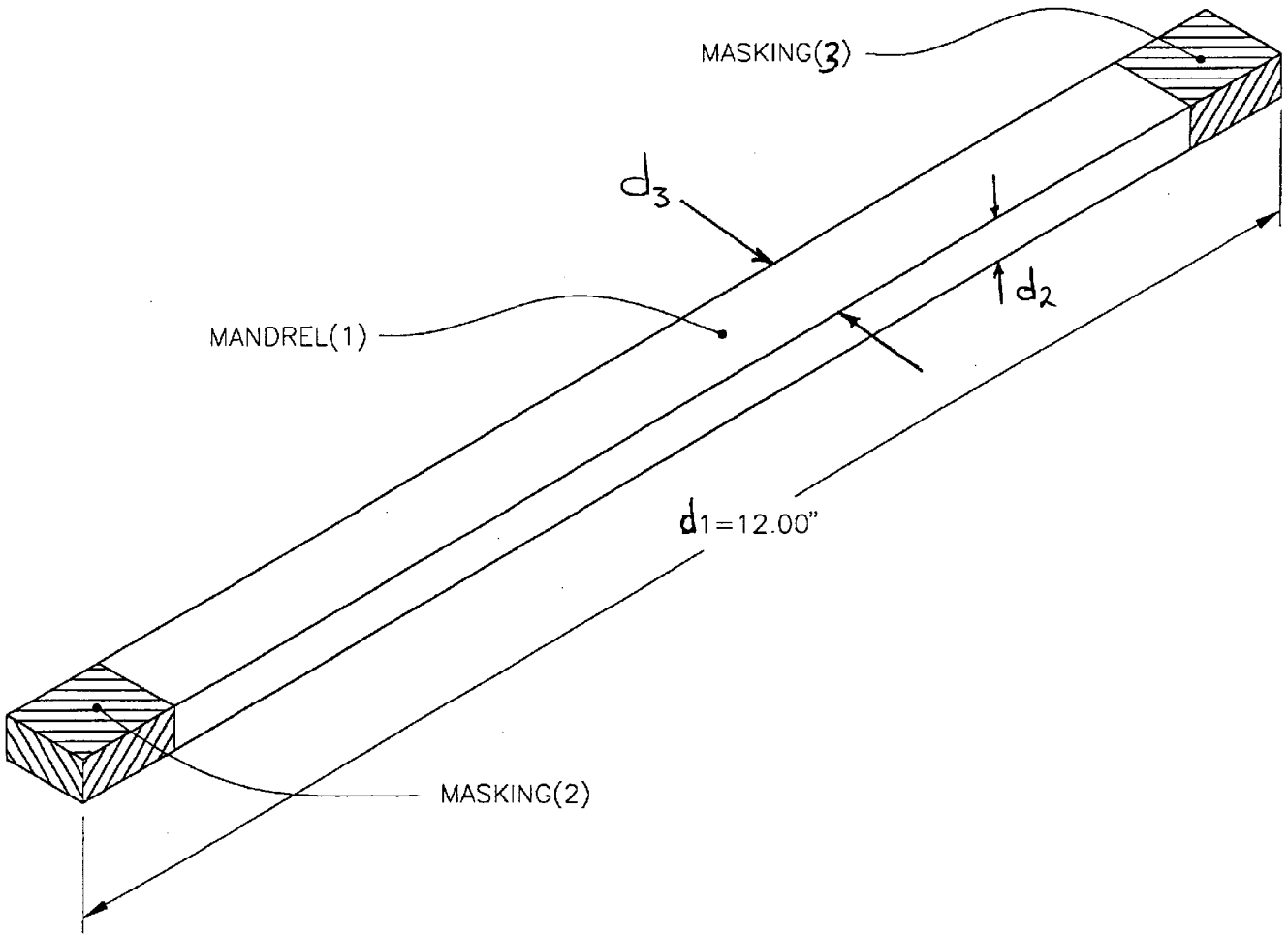
FIG. 1 is a top perspective view of a mandrel having certain masking.

Referring first to FIG. 1 a mandrel 1 is shaped like the hollow rectangular cross section of interior of a microwave waveguide. End segments 2,3 are masked so that forthcoming plating process steps do not involve the masked areas. Nominal dimensions are $d_1$=12.00 inches, $d_2$=0.375", $d_3$=0.75".

Figure 2:
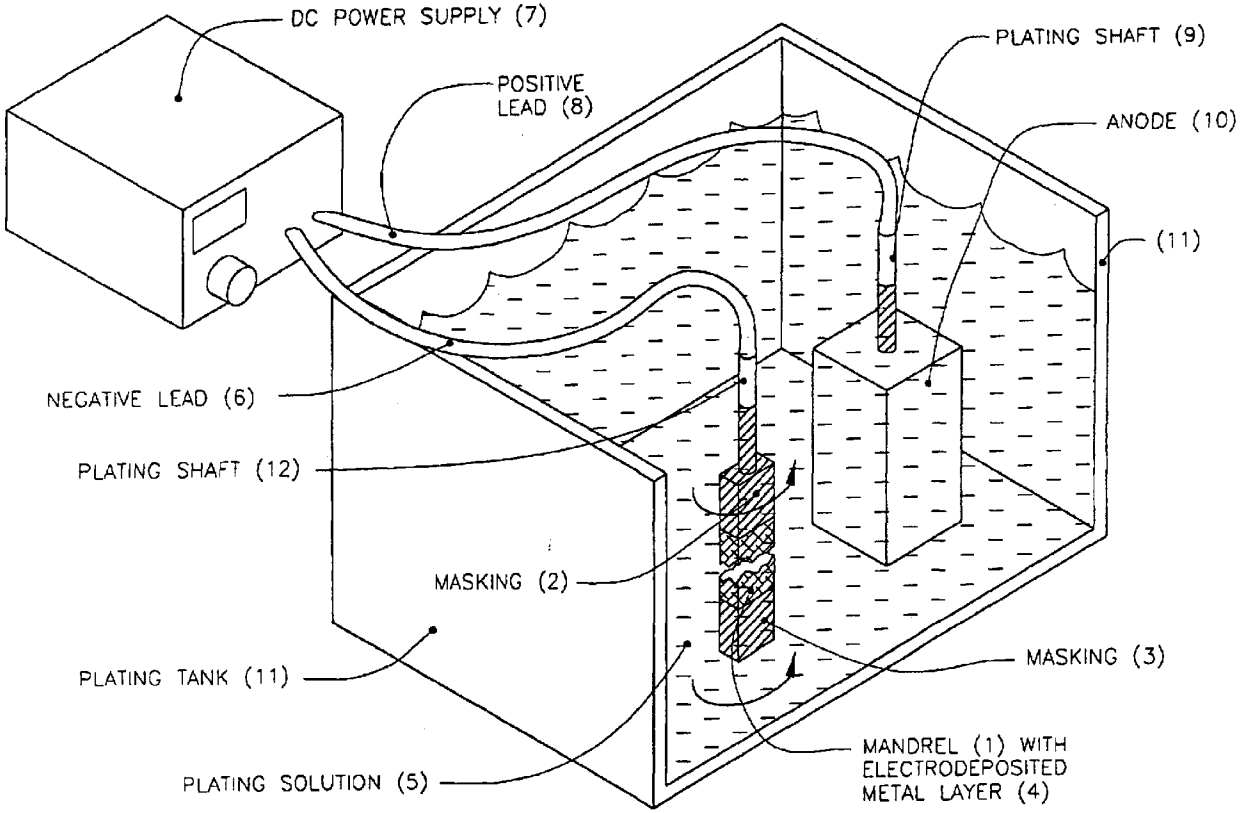
FIG. 2 is a schematic view of the mandrel during the electrodeposition process.

Referring next to FIG. 2 a chemical vat 11 (also called a plating tank) has a plating solution 5 contained therein. An electroformed layer 4 such as copper is being electrodeposited onto the unmasked surfaces of the mandrel 1.

A DC power supply 7 powers the rotating plating shaft 12 with the negative lead 6. The mandrel 1 is rotated as indicated by arrows R to provide a uniform coating thickness (50 millionth to 0.040 inch).

The positive lead 8 is connected to a stationary anode 10 via a plating shaft 9. The steps thus far described are known in the art of electroforming microwave components.

Figures 3, 3A:
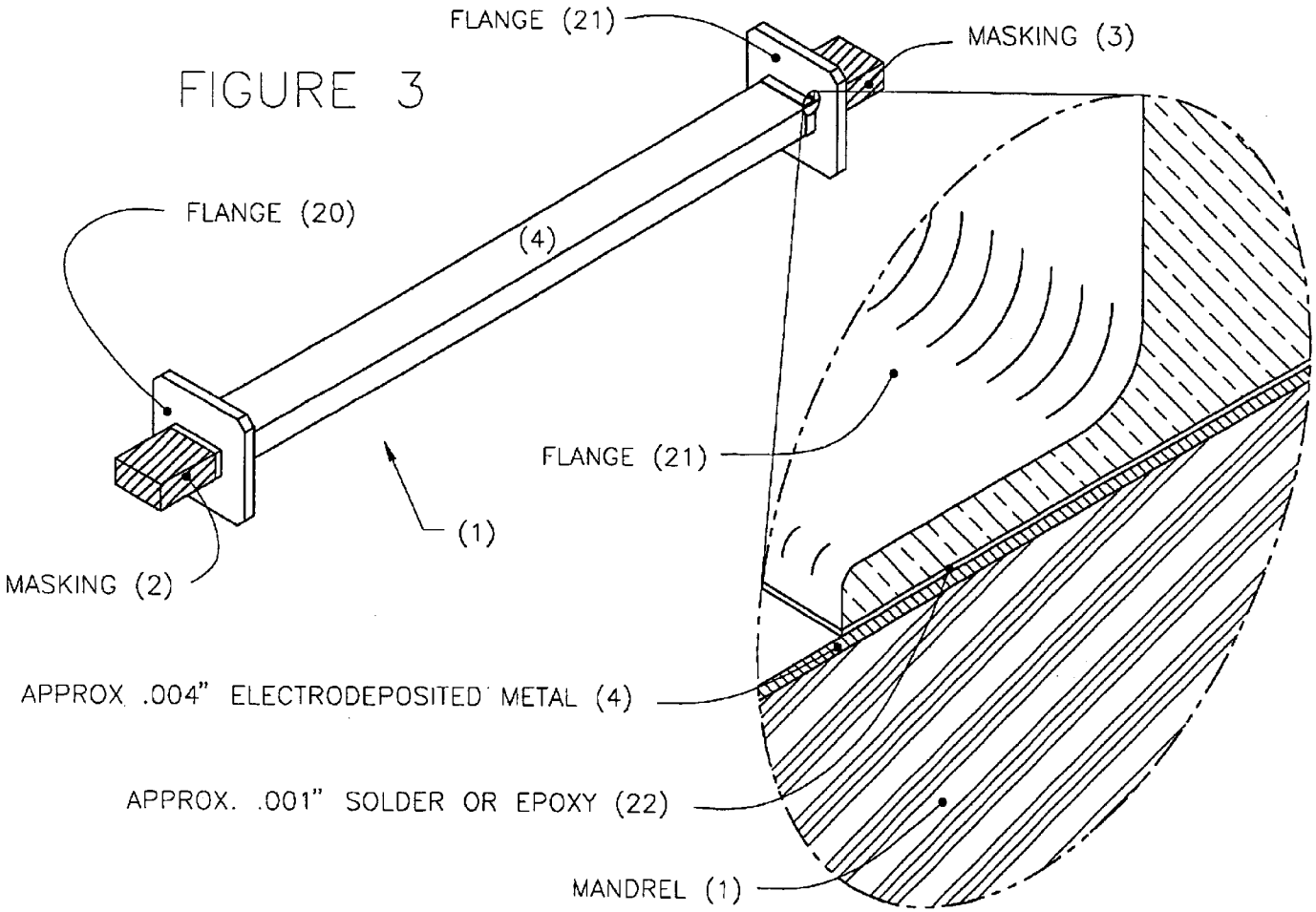
FIG. 3 is a top perspective view of the electroformed mandrel with flanges attached.
FIG. 3A is a cross sectional view of the flange joint.

Referring next to FIGS. 3,3A two flanges 20,21 have been attached to the electrodeposited surface(s) 4 (nominally 0.004" thick) of the mandrel 1. The means for attachment may include epoxy or solder, usually applied at about 0.001" thick.

Figures 4, 4A:
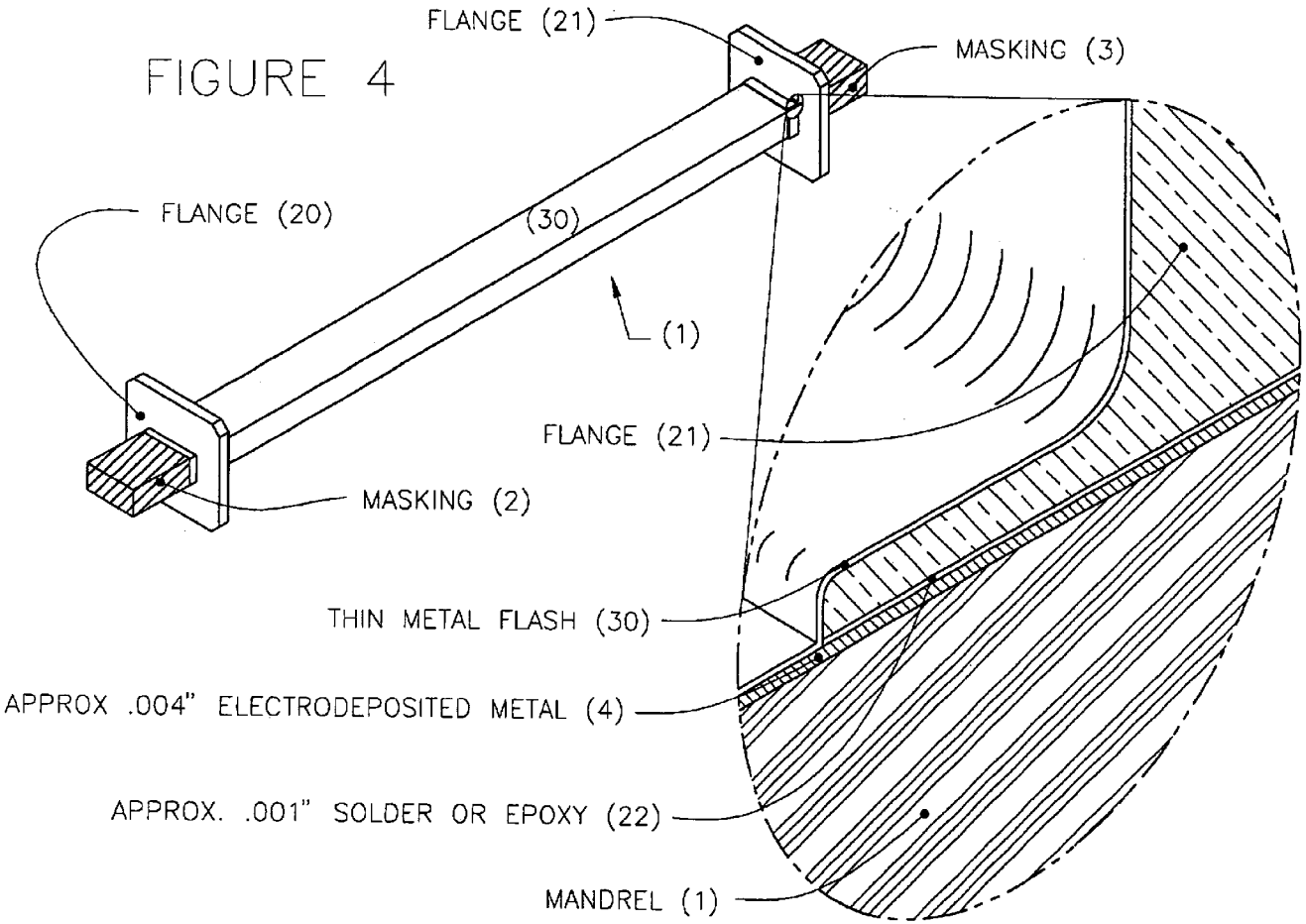
FIG. 4 is the same view as FIG. 3 after the further step of coating the flange joint and mandrel to protect the flange joint.
FIG. 4A is a cross sectional view of the flange joint after a coating process.

Referring next to FIGS. 4,4A another electrodeposited step has occurred similar to that step shown in FIG. 2. A thin metal flash coating 30 now protects the joint 22 from further chemical steps.

Figures 5, 5A:
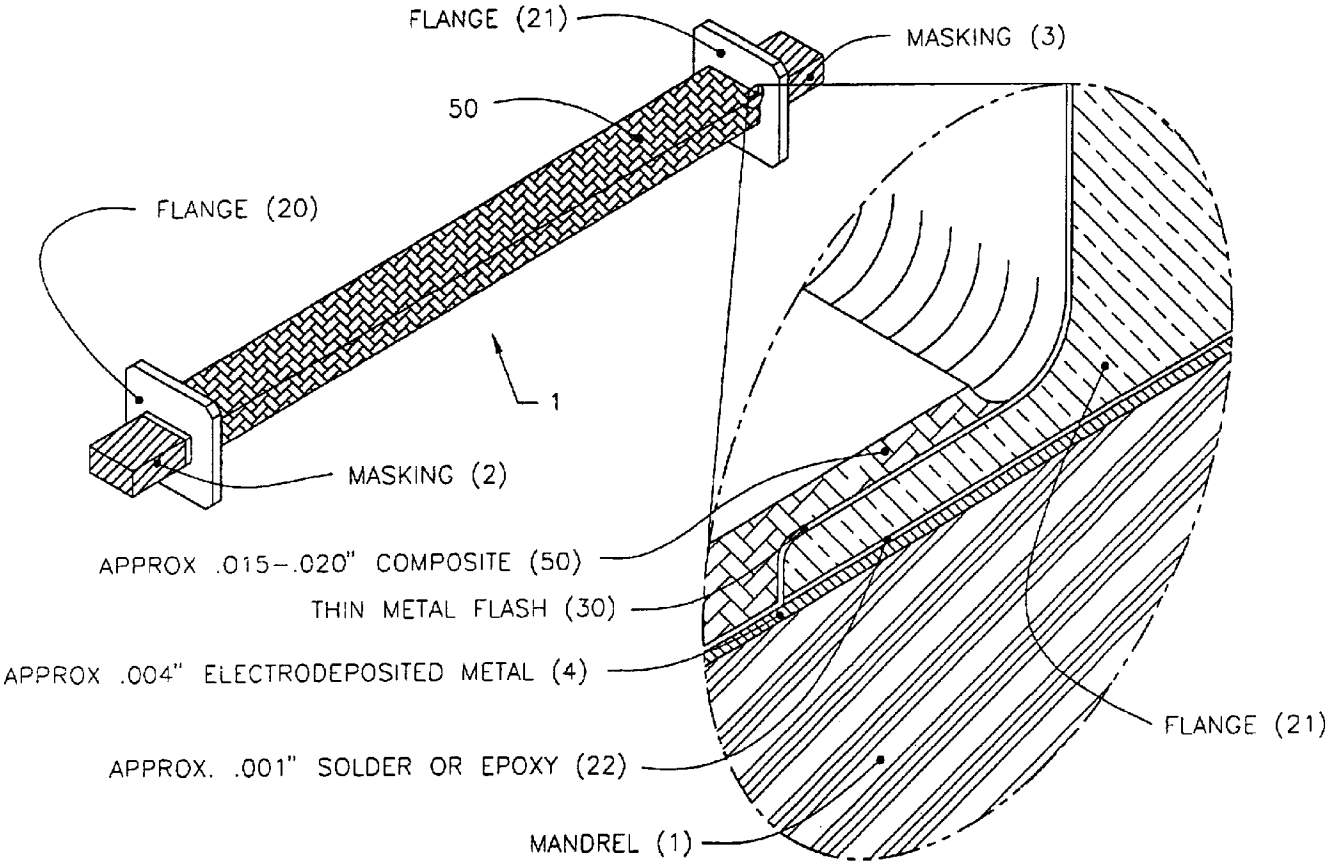
FIG. 5 is a top perspective view of the step of applying the structural composite material to the mandrel and flange sub-assembly.
FIG. 5A is a cross-sectional view of the flange joint after the step of applying the structural composite material.

Referring next to FIGS. 5,5A a composite material 50 has been applied to the mandrel 1. Methods of application may include wrapping (by hand or machine), bonding, spray-up, wet lay-up, hand lay-up, brush-up, painting, molding, and/or 5 foaming.

Figures 6, 6A:
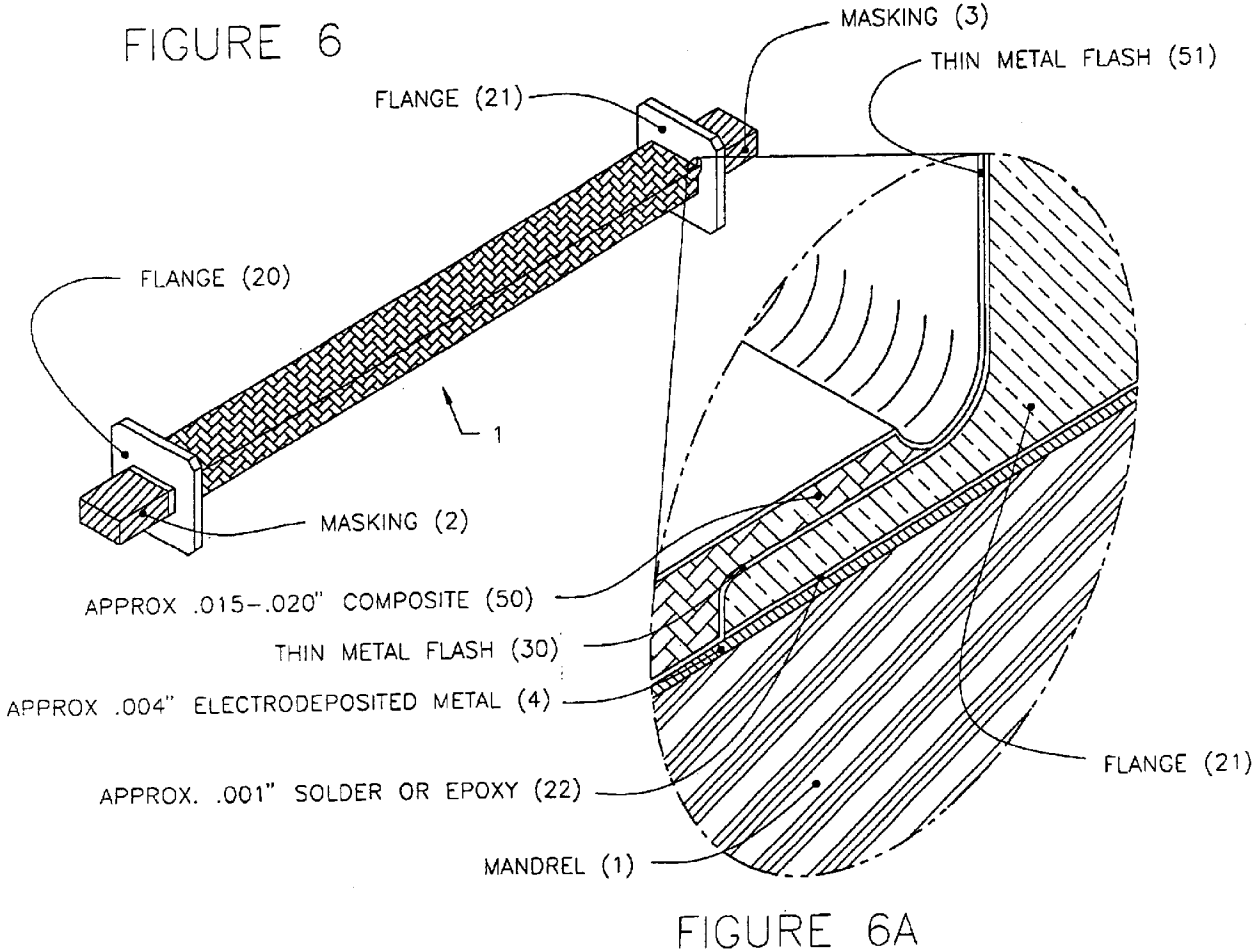
FIG. 6 is a schematic view showing the sub-assembly of FIG. 5 being coated to protect the composite layer from the forthcoming chemical bath.

Referring next to FIGS. 6,6A the final step done before a chemical removal (nitric acid 20–400/o weight/volume) of the mandrel is the chemical coating of a protective thin metal flash 51 (range 0.015 to 0.0500 inch made of copper or nickel) over the composite material 50. The thin metal protective coating is not required where physical removal of the mandrel is possible and may be also not required during chemical removal of the mandrel depending on the properties of the composite and removal chemicals. An aluminum mandrel can be washed away with sodium hydroxide at 60–100 grams per liter. See table below.

| | Mandrel Material | Removal Methods |
|---|---|---|
| Metals | | |
| | Aluminum | Chemical-Sodium Hydroxide 60 to 100 g/l |
| | Zinc | Chemical-Sodium Hydroxide 60 to 100 g/l or Chemical-Hydrochloric Acid 15 to 30% v/v |
| | Steel | Chemical-Hydrochloric Acid 15 to 30% v/v |
| | Stainless Steel | Physical-Removal |
| Plastics/ non-metals | | |
| | ABS | Methylene Chloride |
| | Thermoplastics/ waxes | Thermal Removal, ketone flush |

Figure 7:
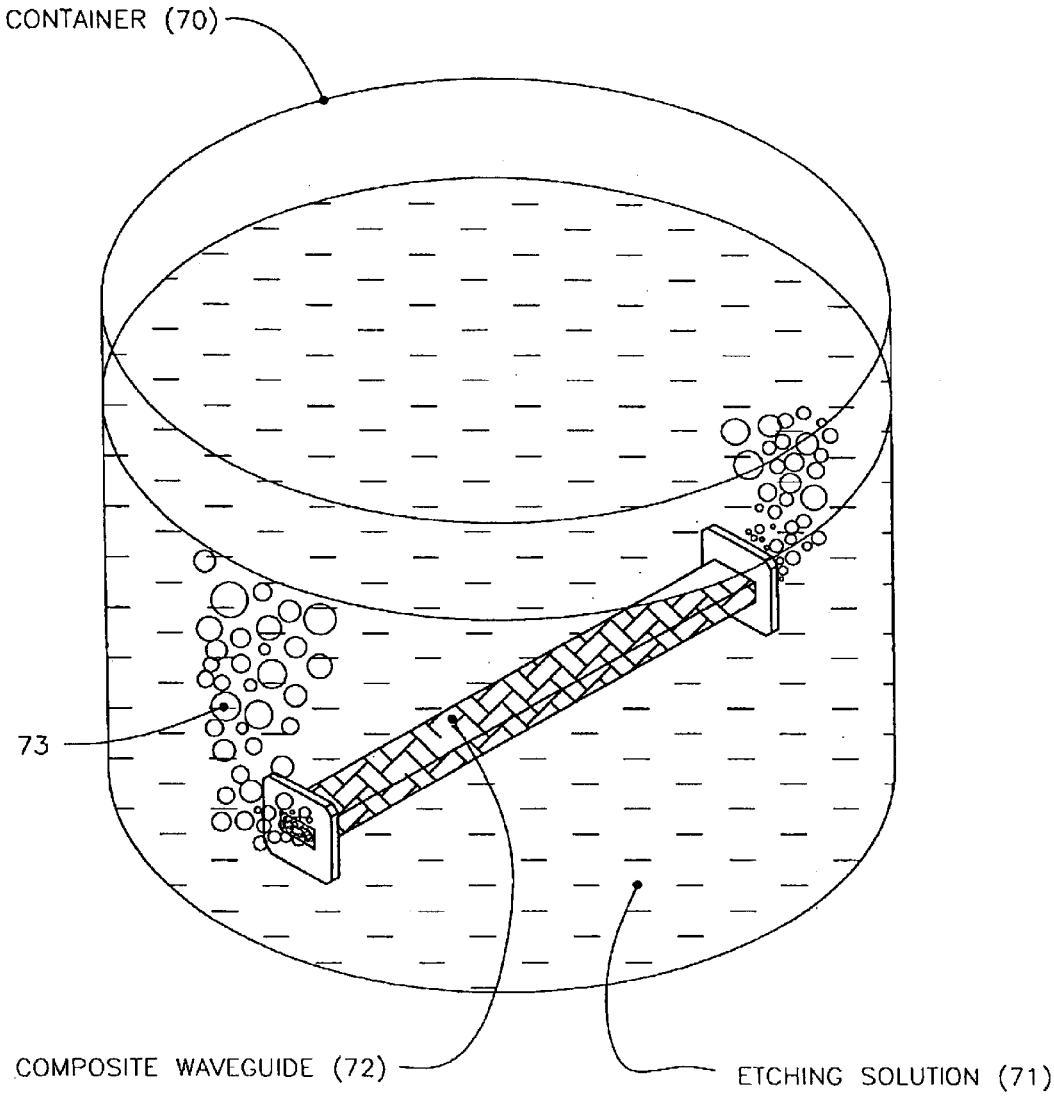
FIG. 7 is a schematic view showing the sub-assembly of FIG. 6 in a chemical bath to remove the mandrel.

Referring next to FIG. 7 the final step in producing a finished product is shown to place the part having the mandrel therein 72 into a container 70 having an etching solution 71 therein. The bubbles 73 show the mandrel 1 being eroded to nothing.

Figures 8, 8A, 8B:
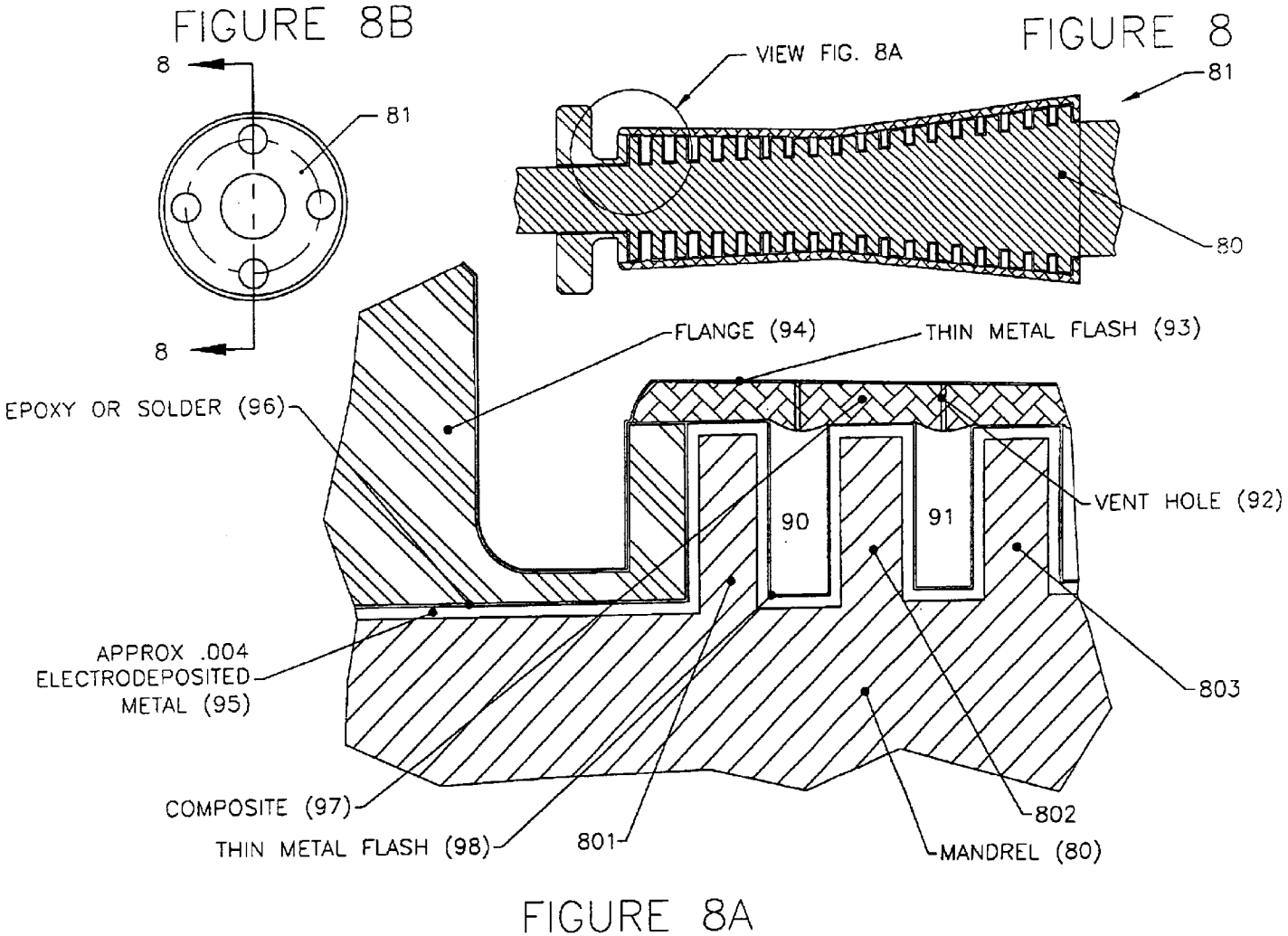
FIG. 8 is a cross sectional taken along line 8—8 of FIG. 8B view of a component which necessitates chemically removing the mandrel.
FIG. 8A is a close up view of the circled portion of FIG. 8.

Referring next to FIGS. 8,8A,8B a part 81 is shown in sectional view in FIGS. 8,8A wherein a physical extraction of the mandrel 80 is impossible. Therefore, steps shown in FIGS. 6,7 are required. The flange 94 is soldered or epoxied at 96 to the electrodeposted metal layer 95. A thin metal flash layer 93 having vent holes 92 protects the composite material 97. A thin metal flash layer 98 covers the layer 95. Mandrel prongs 801,802,803 form the teeth 90,91 in the finished part, and those prongs 801,802,803 forbid the mechanical removal of the mandrel 80.

Figure 9:
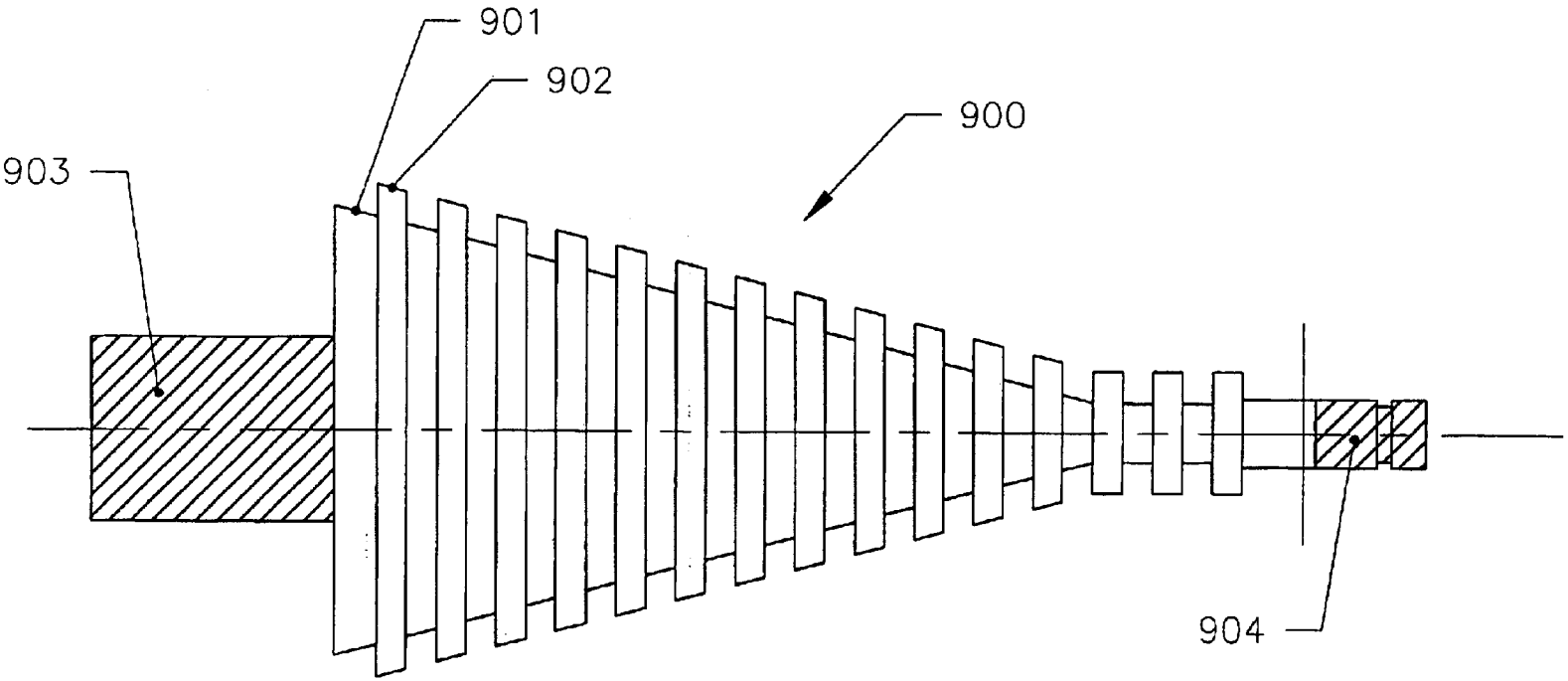
FIG. 9 is a side plan view of a mandrel for a waveguide horn.

Referring next to FIG. 9 a mandrel 900 has been machined into a tapered horn having a plurality of ridges 902 and grooves 901 that symmetrically taper with the dimensions of the horn. The mandrel has a base end 903 and top end 904 which are masked as shown by the cross hatching because those ends 903, 904 are used for handling the mandrel. The unmasked portion of the mandrel is ready to receive a thin layer of metal film by an electrolytic process.

Figure 10:
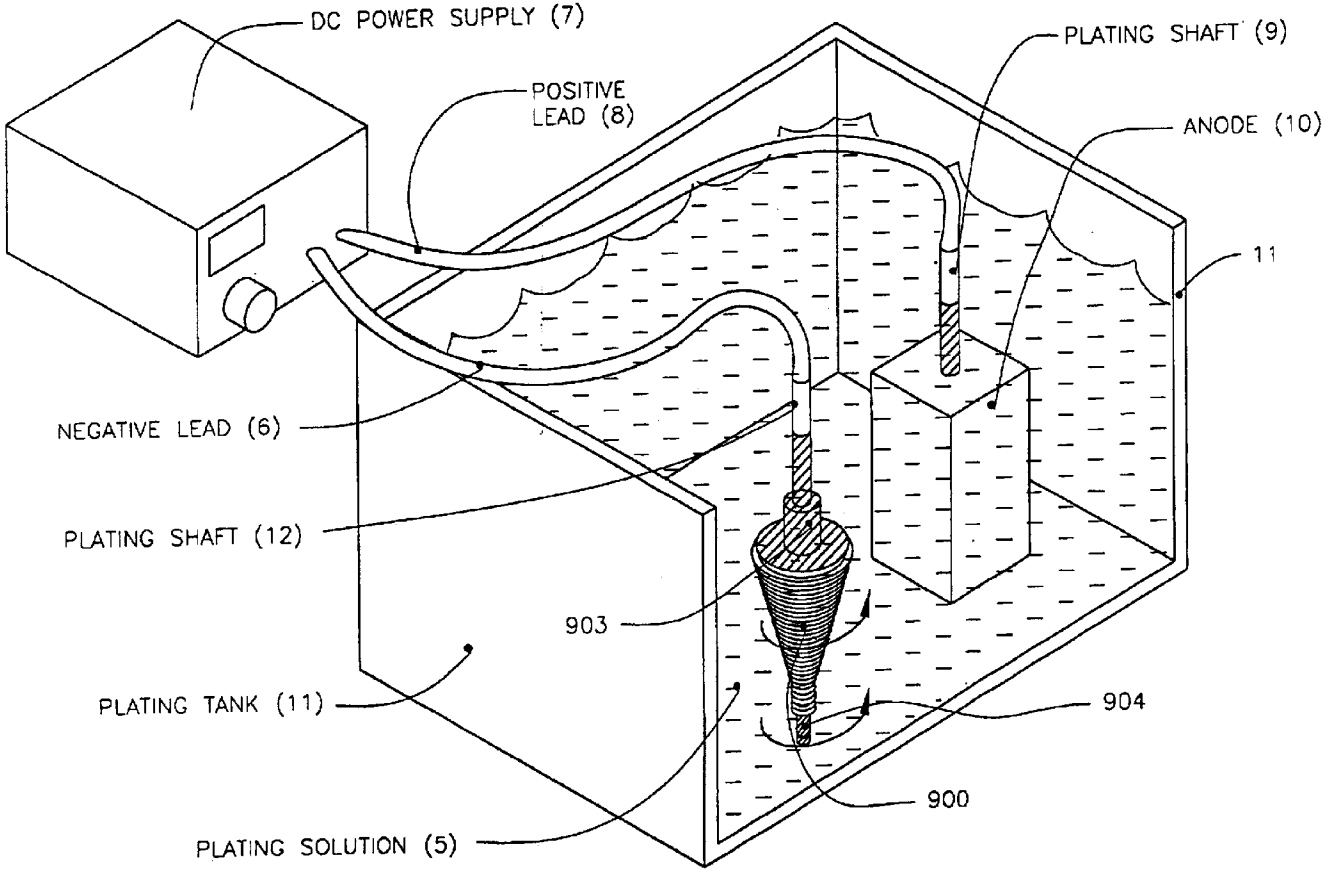
FIG. 10 is a top perspective view of the mandrel shown in FIG. 9 being electroplated in a conventional process.

Referring next to FIG. 10 the same prior art plating tank is shown as contained in FIG. 2. The mandrel 900 is being electrodeposited with a metal layer, preferably the metal is copper.

Figures 11, 12:
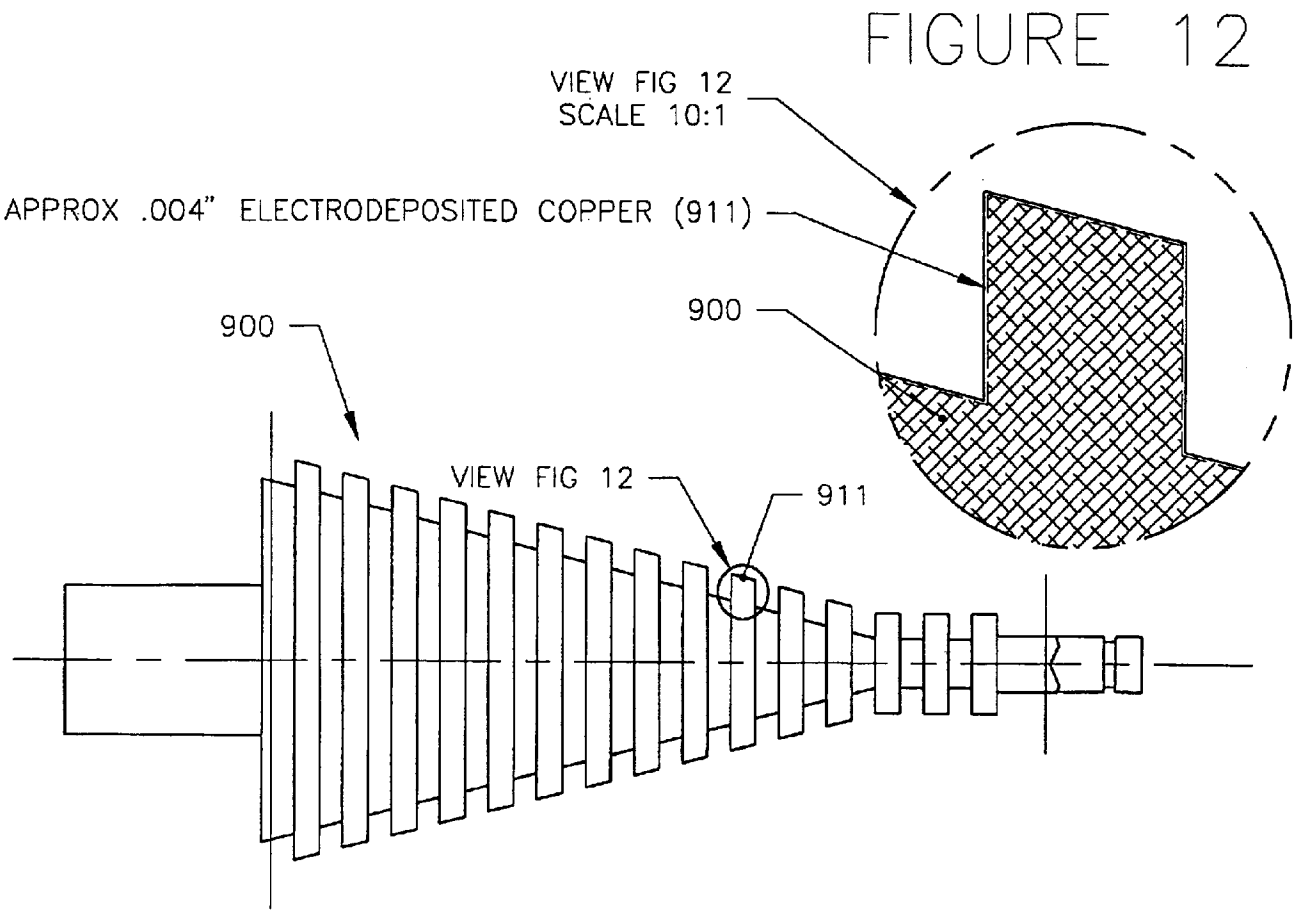
FIG. 11 is a side plan view of the electroplated mandrel from FIG. 10.
FIG. 12 is a close up sectional view of one segment of the coated mandrel of FIG. 11.

Referring next to FIGS. 11, 12 the mandrel 900 has been removed from the plating tank and now has a thin (about 0.004 inch) electrodeposited layer of copper 911 evenly coated over all the unmasked outer surface of the mandrel 900 including the ridges 902 and grooves 901.

Referring next to FIGS. 13, 14 a flange 1300 has been attached to the mandrel 900 after the electrodepositing step. A layer of epoxy (or solder) 1301 about 0.001 inch thick was applied to the end 910 of the mandrel 900 to secure the flange 1300.

Figure 15:
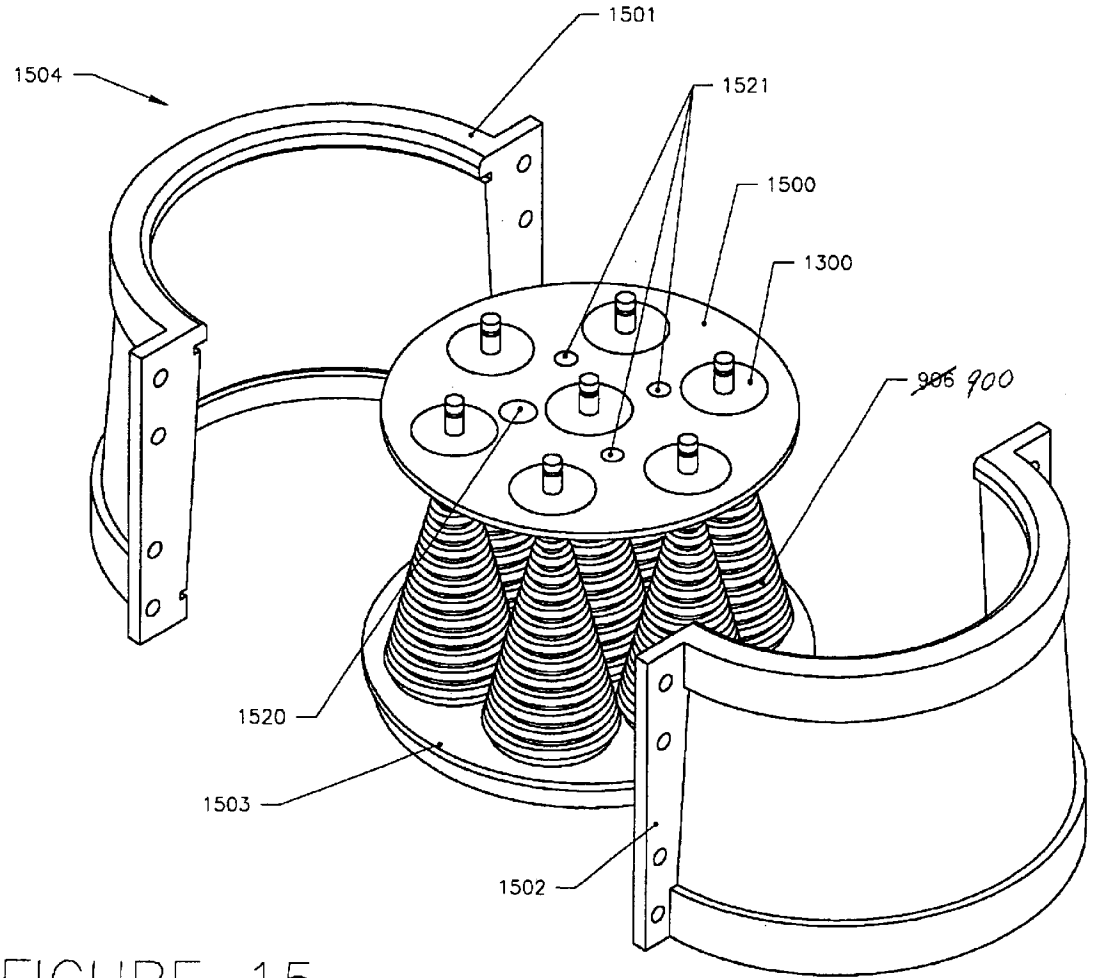
FIG. 15 is a top perspective view of an array of coated mandrels each like the coated mandrel of FIG. 11.

Referring next to FIG. 15 an array of horns is being manufactured by first attaching six electrodeposited mandrels 900 on a bottom mold plate 1503, then attaching the tops of the six mandrels to a top mold plate 1500, then securing the mold plates 1500, 1503 inside the composite mold 1504 which has halves 1501, 1502. The term compact waveguide assembly herein covers a group of dissimilar components as well as a group of similar components as shown in the FIG. 15 example, wherein the group of similar components is called an array.

Figure 16:
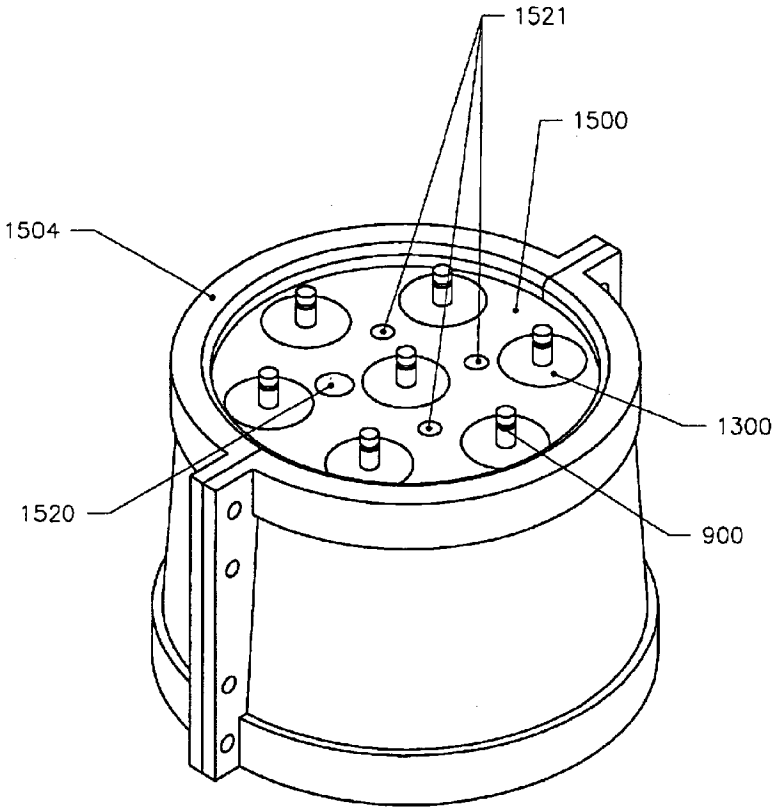
FIG. 16 is a top perspective view of the array of FIG. 15 ready for a foaming step to apply a composite material around the array of mandrels.

Referring next to FIG. 16 the composite mold 1504 is assembled and ready to receive a fluid form of composite material in pour hole 1520, wherein holes 1521 are release holes for air.

Figures 17, 18:
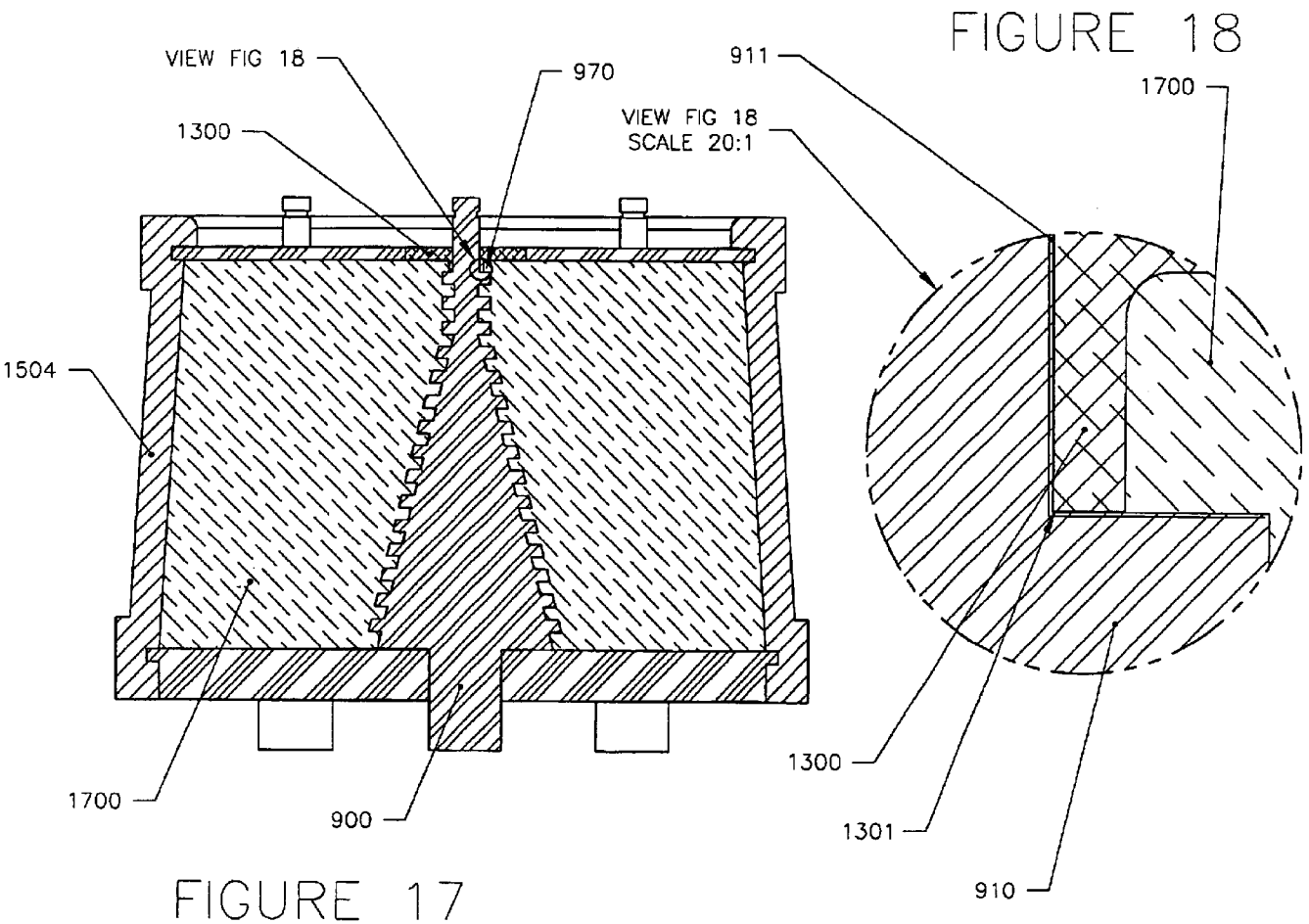
FIG. 17 is a cross sectional view of the one array member in the foamed assembly of FIG. 16.
FIG. 18 is a close up view of the flange joint shown in FIG. 17.
Figure 19:
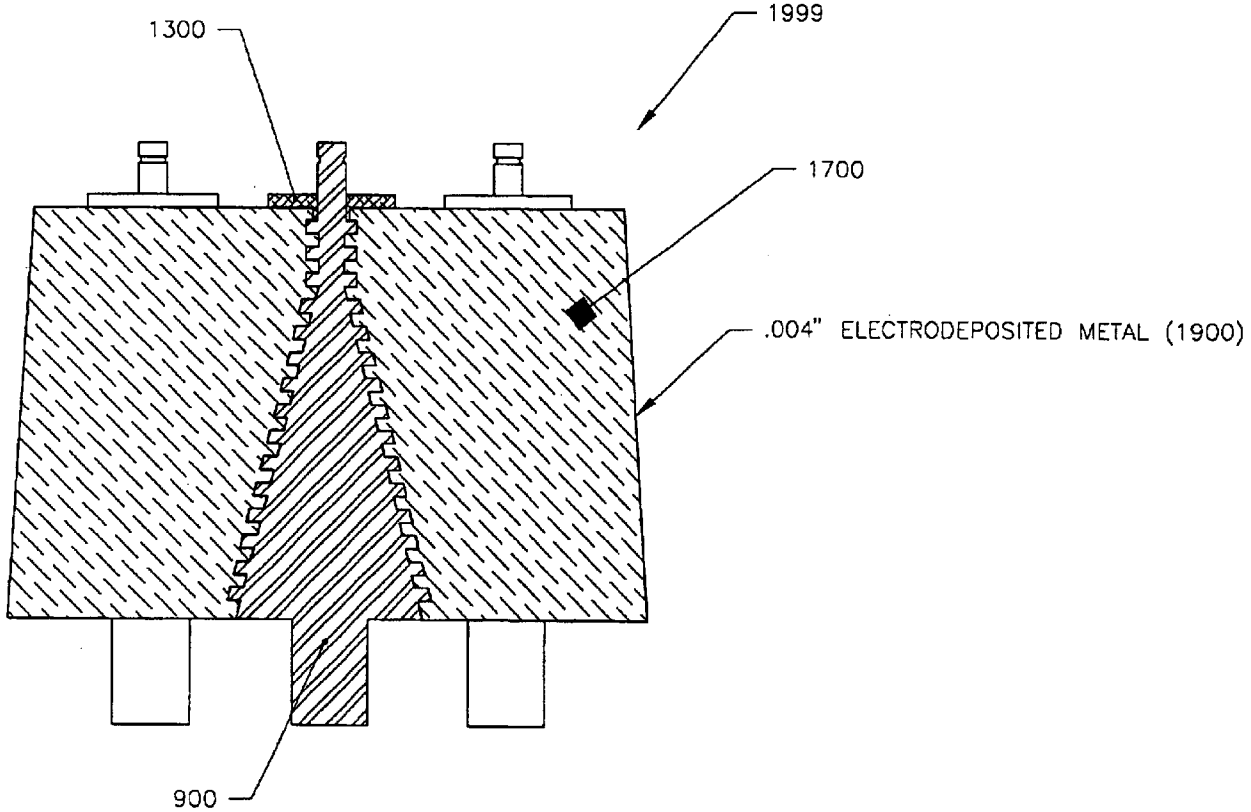
FIG. 19 is a cross sectional view of the foamed array of FIG. 17 with a protective layer applied to the outside surface of the composite material.
Figure 20:
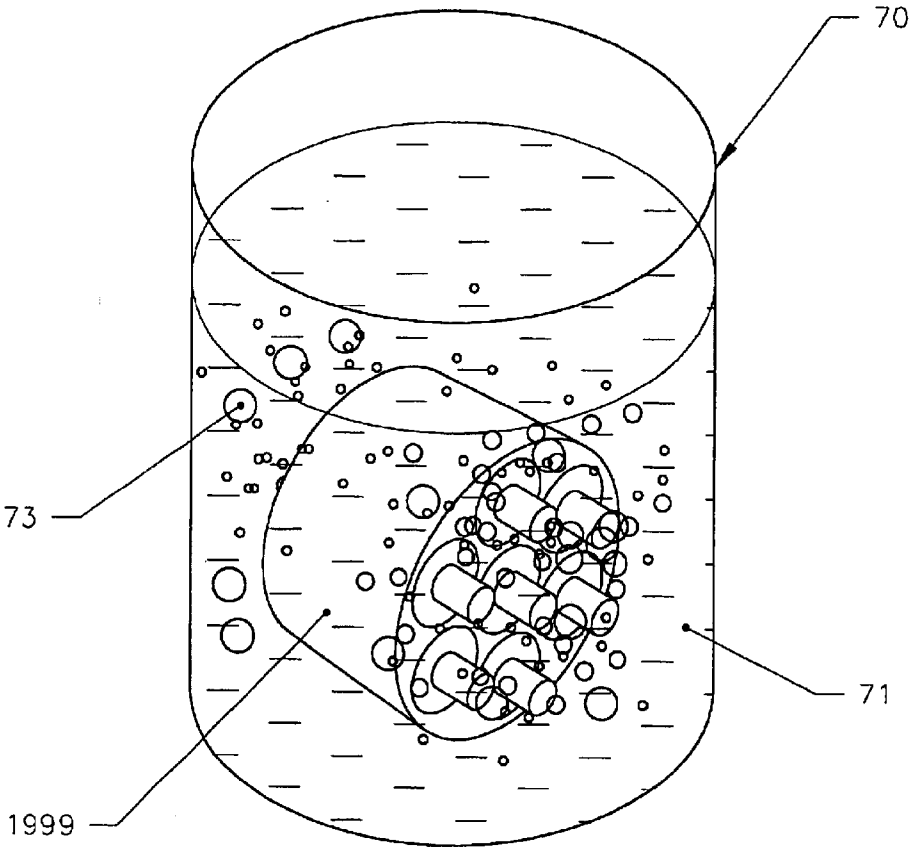
FIG. 20 is a top perspective view of the assembly of FIG. 19 being processed in an acid bath to remove the mandrels.

In FIGS. 17, 18 the composite fluid has hardened forming composite layer 1700. FIG. 19 shows the removal of the composite mold 1504 thereby exposing horn array 1999. The horn array 1999 has been further electrodeposited to form a protective layer 1900 around it (about 0.002 inch of metal). Now the mandrels 900 can be chemically removed as shown in FIG. 20. The same process is used as in FIG. 7.

Figures 21, 22:
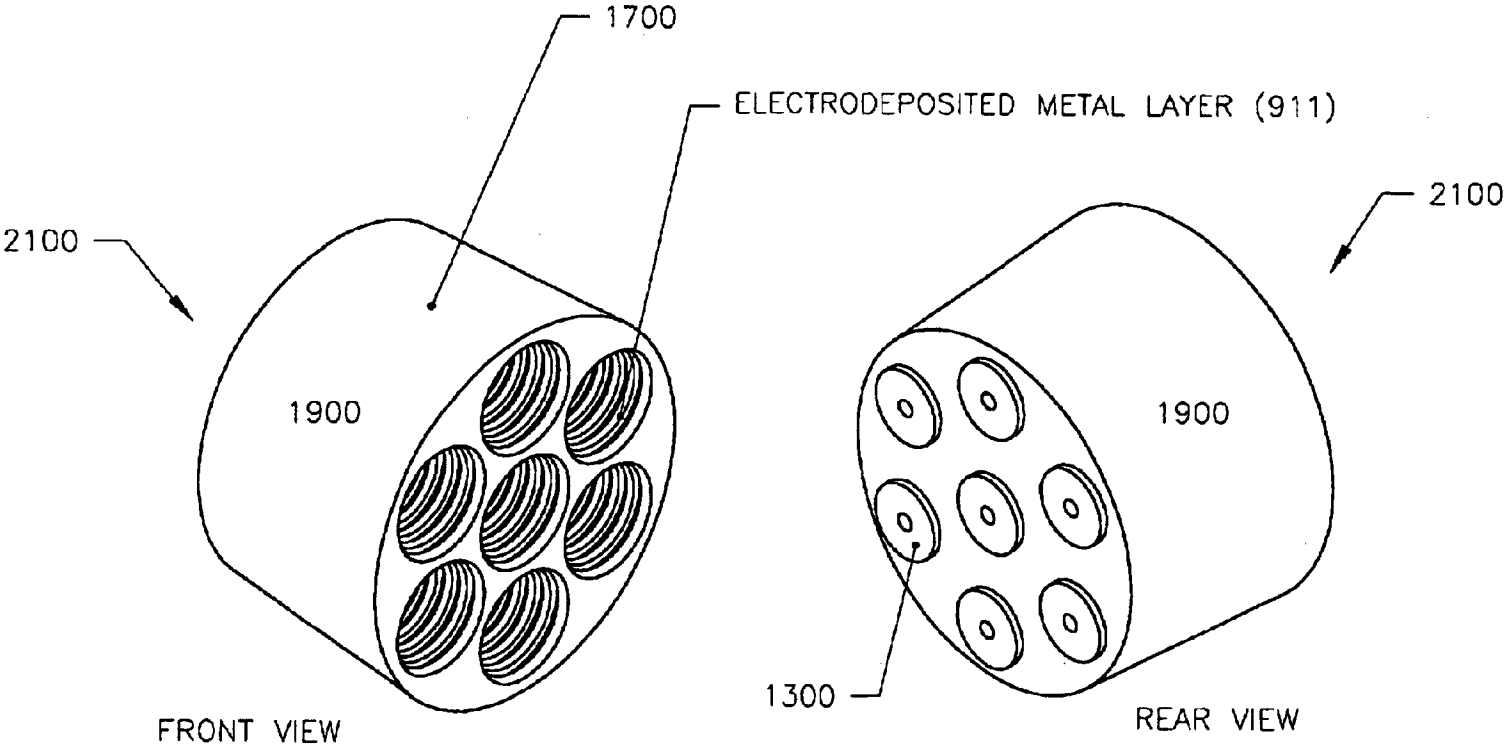
FIG. 21 is a front perspective view of the completed array after the step shown in FIG. 20.
FIG. 22 is a rear perspective view of the array shown in FIG. 21.

Referring next to FIGS. 21, 22 the end product, an array of horns, 2100, is shown with the mandrels chemically removed.

Figure 23:
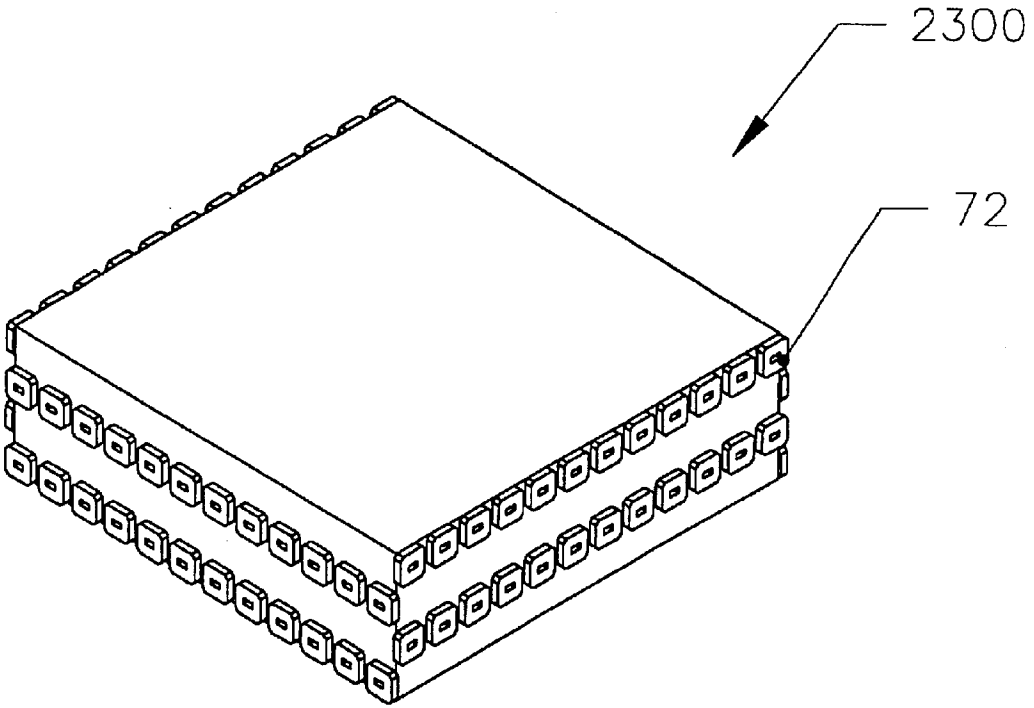
FIG. 23 is a top perspective view of a different array product.

Referring next to FIG. 23 an array of waveguides 2300 is composed of a plurality of individual waveguides 72 (FIG. 7). The array of waveguides 2300 was made with the same process steps as the array 2100.

Figure 24:
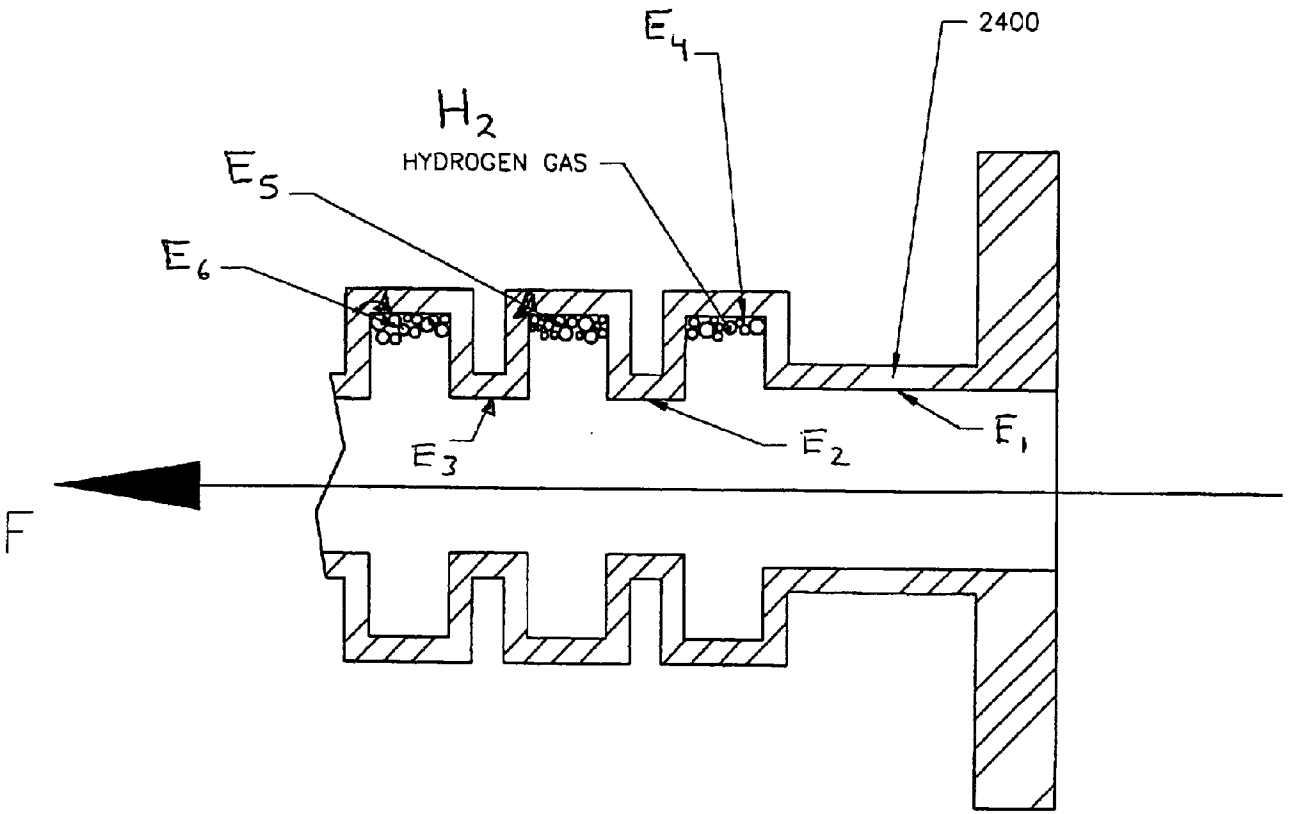
FIGURE 24 (PRIOR ART)
FIG. 24 (prior art) is a cross sectional view of a prior art outside in process showing the problem of coating the inside of a complex part with a chemical plating method.

Referring next to FIG. 24 (prior art) the problem of making a complex waveguide from the outside in is shown with the composite shell 2400 already formed. The shell 2400 is being chemically plated with a flow F of a plating fluid. A uniform plating can occur at surfaces $E_1$, $E_2$, $E_3$ because of a constant flow rate at those surfaces. However, no uniform flow rate at surfaces $E_4$, $E_5$, $E_6$ results in non-uniform plating and pin holes. Trapped hydrogen $H_2$ further degrades the plating of surfaces $E_4$, $E_5$ $E_6$.

Although the present invention has been described with reference to preferred embodiments, numerous modifications and variations can be made and still the result will come within the scope of the invention. No limitation with respect to the specific embodiments disclosed herein is intended or should be inferred.

We claim:

1. A method to form a component from the "inside out" comprising the steps of:

forming a mandrel;

coating the mandrel with an inner surface of the component;

applying a composite material around the coated mandrel; and removing the mandrel.

2. The method of claim 1 further comprising the step of applying a protective coating over the composite material, then chemically removing the mandrel, and then chemically removing the protective coating.

3. The method of claim 1 further comprising the step of forming the mandrel to a dimensional accuracy of ±0.0005 inch.

4. The component formed by claim 1.

5. A method to form an assembly of waveguide components comprising the steps of:

forming a first mandrel;

forming a second mandrel;

coating the first and second mandrels with an inner surface of a first and second component;

placing the first and second mandrels in a common area;

coating the first and second mandrels with a composite material; and removing the first and second mandrels from the first and second inner surfaces.

6. The method of claim 5 further comprising the step of connecting the first and second mandrels.

7. The method of claim 6 further comprising the step of chemically removing the mandrels in a common vat.

8. The method of claim 7 further comprising the step of forming a protective coating over the coated mandrel before chemically removing the mandrel.

9. The method of claim 8 further comprising the step of removing the protective coating.

10. The assembly formed by claim 5.

11. A method to form a low weight, high performance waveguide from the "inside out", comprising the steps of:

forming a disposable mandrel in a desired shape of the waveguide to a dimensional accuracy of ±0.0005 inch;

coating the mandrel with a metal, thereby forming an inner surface of the waveguide;

applying a composite material around the coated, disposable mandrel; and chemically removing the disposable mandrel.

12. The method of claim 11 further comprising the step of applying a protective coating over the composite material, then chemically removing the disposable mandrel, and then chemically removing the protective coating.

* * * * *